US010196875B2

(12) United States Patent
Zhao et al.

(10) Patent No.: US 10,196,875 B2
(45) Date of Patent: Feb. 5, 2019

(54) DEPLOYMENT OF EXPANDABLE GRAPHITE

(71) Applicants: Lei Zhao, Houston, TX (US); Caleb R. Newman, Houston, TX (US); Edward T. Wood, Kingwood, TX (US); Zhiyue Xu, Cypress, TX (US)

(72) Inventors: Lei Zhao, Houston, TX (US); Caleb R. Newman, Houston, TX (US); Edward T. Wood, Kingwood, TX (US); Zhiyue Xu, Cypress, TX (US)

(73) Assignee: BAKER HUGHES, A GE COMPANY, LLC, Houston, TX (US)

( * ) Notice: Subject to any disclaimer, the term of this patent is extended or adjusted under 35 U.S.C. 154(b) by 843 days.

(21) Appl. No.: 14/501,889

(22) Filed: Sep. 30, 2014

(65) Prior Publication Data

US 2016/0090812 A1 Mar. 31, 2016

(51) Int. Cl.

| | |
|---|---|
| ***E21B 33/10*** | (2006.01) |
| ***E21B 33/12*** | (2006.01) |
| ***E21B 36/00*** | (2006.01) |
| ***C06D 3/00*** | (2006.01) |

(52) U.S. Cl.

CPC ..... *E21B 33/1208* (2013.01); *C06D 3/00* (2013.01); *E21B 33/10* (2013.01); *E21B 36/00* (2013.01)

(58) Field of Classification Search

CPC ..... C06D 3/00; E21B 36/00

See application file for complete search history.

(56) References Cited

U.S. PATENT DOCUMENTS

| | | | | |
|---|---|---|---|---|
| 4,234,638 | A | 11/1980 | Yamazoe et al. | |
| 4,388,227 | A | 6/1983 | Kalnin et al. | |
| 5,134,030 | A | 7/1992 | Ueda et al. | |
| 5,228,701 | A | 7/1993 | Greinke et al. | |
| 5,656,794 | A * | 8/1997 | Krone ..... | C06D 3/00 102/334 |

(Continued)

FOREIGN PATENT DOCUMENTS

| | | |
|---|---|---|
| CN | 1034217 A | 7/1989 |
| CN | 2070816 U | 2/1991 |

(Continued)

OTHER PUBLICATIONS

International Search Report, International Application No. PCT/US2015/046795, dated Nov. 3, 2015, Korean Intellectual Property Office; International Search Report 4 pages.

(Continued)

*Primary Examiner* — Aileen B Felton

(74) *Attorney, Agent, or Firm* — Cantor Colburn LLP

(57) ABSTRACT

A method of deploying an apparatus in a wellbore comprises positioning a device at a predetermined location; wherein the device comprises a composition that contains an expandable graphite, and a metallic binder, and wherein the composition has a first shape; and exposing the composition to a microwave energy to cause the composition to attain a second shape different from the first shape. Alternatively, the composition further comprises an activation material comprising a thermite, a mixture of Al and Ni, or a combination comprising at least one of the foregoing and a method of deploying an apparatus comprising such a composition includes exposing the composition to a selected form of energy.

18 Claims, 2 Drawing Sheets

(56) References Cited

U.S. PATENT DOCUMENTS

| | | | | |
|---|---|---|---|---|
| 5,992,857 | A | 11/1999 | Ueda et al. | |
| 6,102,120 | A | 8/2000 | Chen et al. | |
| 6,105,596 | A | 8/2000 | Hoyes et al. | |
| 6,152,453 | A | 11/2000 | Kashima et al. | |
| 6,933,531 | B1 | 8/2005 | Ishikawa et al. | |
| 7,479,513 | B2 * | 1/2009 | Reinheimer | C08K 9/02 252/378 R |
| 2003/0145924 | A1 * | 8/2003 | Carter, Jr. | C06B 33/00 149/37 |
| 2004/0127621 | A1 | 7/2004 | Drzal et al. | |
| 2007/0142547 | A1 | 6/2007 | Vaidya et al. | |
| 2008/0296023 | A1 | 12/2008 | Willauer et al. | |
| 2013/0001475 | A1 | 1/2013 | Christ et al. | |
| 2013/0056209 | A1 | 3/2013 | Mazyar et al. | |
| 2013/0256991 | A1 | 10/2013 | Ramon et al. | |
| 2014/0051612 | A1 | 2/2014 | Mazyar et al. | |
| 2015/0122483 | A1 | 5/2015 | Xu et al. | |
| 2015/0145217 | A1 | 5/2015 | Zhao et al. | |
| 2015/0158772 | A1 | 6/2015 | Zhao et al. | |
| 2015/0211326 | A1 * | 7/2015 | Lowry | E21B 33/13 102/364 |
| 2016/0145965 | A1 | 5/2016 | Zhao et al. | |

FOREIGN PATENT DOCUMENTS

| | | | |
|---|---|---|---|
| CN | 1426960 | A | 7/2003 |
| CN | 1513758 | A | 7/2004 |
| CN | 1572824 | A | 2/2005 |
| CN | 1680502 | A | 10/2005 |
| CN | 201730583 | U | 2/2011 |
| CN | 102448702 | A | 5/2012 |
| CN | 202810772 | U | 3/2013 |
| CN | 203257364 | U | 10/2013 |
| CN | 103781990 | A | 5/2014 |
| KR | 20100004399 | A | 1/2010 |

OTHER PUBLICATIONS

International Written Opinion, International Application No. PCT/US2015/046795, dated Nov. 3, 2015, Korean Intellectual Property Office; Written Opinion 10 pages.

European Search Report, EP Application No. 15845851.3, dated Aug. 28, 2018, European Patent Office; EP Search Report 8 pages.

Chinese Office Action, CN Application No. 2015800508933, dated Oct. 8, 2018, State Intellectual Property Office of the People's Republic of China; English Translation of Office Action 16 pages; Chinese Office Action 11 pages.

* cited by examiner

DEPLOYMENT OF EXPANDABLE GRAPHITE

BACKGROUND

Elastomers are commonly used as sealing materials in downhole applications because of their ability to seal to surfaces that are rough or include imperfections. Applications for such seals include tubular systems employed in earth formation boreholes such as in the hydrocarbon recovery and carbon dioxide sequestration industries. The elastomers however can degrade at high temperatures and high pressures and in corrosive environments. Thus, the industry is always receptive to improved materials, apparatus, and methods for deploying the same in wellbores to perform various functions, such as filing annular spaces, isolating zones, and providing seals.

BRIEF DESCRIPTION

Disclosed herein is a method of deploying an apparatus. The method comprises: positioning a device at a predetermined location; wherein the device comprises a composition that contains an expandable graphite, and a binder, and wherein the composition has a first shape; and exposing the composition to a microwave energy to cause the composition to attain a second shape different from the first shape.

In another aspect, there is provided a composition comprising: an expandable graphite; and an activation material comprising a thermite, a mixture of Al and Ni, or a combination comprising at least one of the foregoing.

Also disclosed is a device comprising a composition containing: an expandable graphite; a binder; and an activation material comprising a thermite, a mixture of Al and Ni, or a combination comprising at least one of the foregoing.

A method of preparing a device comprises: compounding an expandable graphite; a binder; and an activation material comprising a thermite, a mixture of Al and Ni, or a combination comprising at least one of the foregoing, to form a mixture; and compression molding the mixture at a temperature less than 100° F.

In another aspect, a method of deploying an apparatus comprises: positioning a device at a predetermined location; wherein the device comprises a composition that contains an expandable graphite; a binder; and an activation material comprising a thermite, a mixture of Al and Ni, or a combination comprising at least one of the foregoing, and wherein the composition has a first shape; and exposing the composition to a selected form of energy to cause the composition to attain a second shape different from the first shape.

BRIEF DESCRIPTION OF THE DRAWINGS

The following descriptions should not be considered limiting in any way. With reference to the accompanying drawings, like elements are numbered alike.

DETAILED DESCRIPTION

Figure 1A:
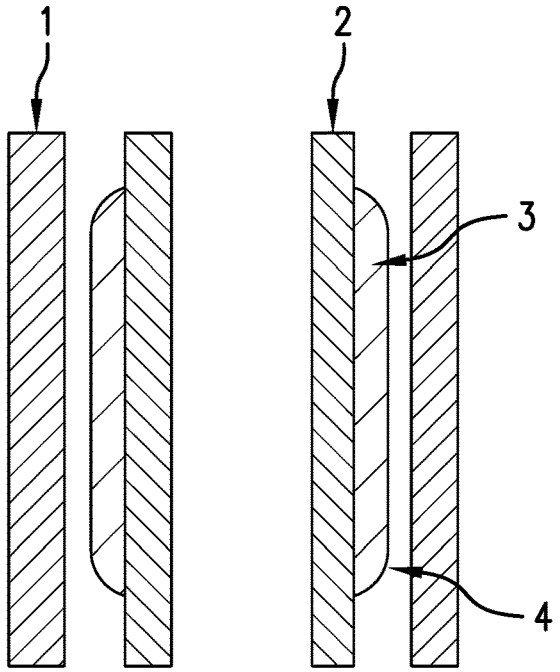
FIG. 1A shows a longitudinal cross-section of a casing, product tube, and downhole element where the downhole element is seated against an outer diameter of the production tube.

Graphites are made up of layers of hexagonal arrays or networks of carbon atoms, which are held together only by weak van der Waals forces. Expandable graphite, a synthesized intercalation compound of graphite, can expand hundreds of times in volume upon heating. The expanded graphite has high thermal and chemical stability, flexibility, compressibility, and conformability and is a promising alternative sealing or packing material for a variety of applications.

However, rather than forming expanded graphite first and then deploying the expanded graphite at a different time and/or location, the inventors have found that under certain circumstances, it may be advantageous to deploy the expandable graphite and expand it when in use. In-situ activation of expandable graphite, for example, in downhole conditions can be challenging because high temperature heating source is commonly required in order to activate (expand) expandable graphite, increasing operation cost and causing thermal damages to other downhole tools.

The inventors hereof have found that expandable graphite can be activated via two activation means, namely, microwave energy and triggered chemistry without introducing any detrimental heat source. In the microwave method, a microwave source generates intense microwave energy focused on the expandable graphite only causing the expandable graphite to expand thus performing desirable sealing or packing functions.

In the trigger chemistry method, an activation material is blended with expandable graphite forming a composite. When the activation material is exposed to electric current, an electromagnetic radiation, or heat (triggered), an intense exothermic reaction occurs and generates large amounts of localized heat in factions of a second. The generated heat provides sufficient thermal shock to expand the expandable graphite. Because the heat is generated locally in the composite and is quickly absorbed by expandable graphite, any detrimental effects to other parts of the tool are greatly minimized or avoided.

The advantages of the in-situ activation of expandable graphite disclosed herein include quick set up, low cost, high safety, and improved reliability. Further, the compositions containing expandable graphite exhibit a desirable elastic modulus following their activation in-situ, thereby enabling a desired tightness of sealing of a space in the wellbore, which space may be in an open wellbore or cased wellbore. In one aspect, such methods may offer to a rig operator adequate time and opportunity for optimized positioning of the devices made using such materials, while still ensuring a desirably tight "fit" or "seal" within the wellbore without significant edge voids, regardless of anomalies in the shape or construction of the wellbore. Because the activation of the expandable containing compositions can be controlled, such materials may be deployed or activated after the apparatus comprising such materials has been positioned at the downhole location, thus, preventing the deployment of such apparatus during placement of the apparatus in the wellbore.

In an embodiment, a method of deploying an apparatus comprises: positioning a device at a predetermined location;

wherein the device comprises a composition that contains an expandable graphite and a binder, and wherein the composition has a first shape; and exposing the composition to a microwave energy to cause the composition to attain a second shape different from the first shape. The method can further comprise isolating or completing a wellbore by deploying the apparatus in the wellbore. As used herein, the device can be the same as the apparatus or the device can be part of the apparatus.

As used herein, expandable graphite refers to graphite having intercallant materials inserted between layers of graphite. Graphite includes natural graphite, kish graphite, pyrolytic graphite, etc. A wide variety of chemicals have been used to intercalate graphite materials. These include acids, oxidants, halides, or the like. Exemplary intercallant materials include sulfuric acid, nitric acid, chromic acid, boric acid, $SO_3$, or halides such as $FeCl_3$, $ZnCl_2$, and $SbCl_5$. Upon heating, the intercallant is converted from a liquid or solid state, to a gas phase. Gas formation generates pressure which pushes adjacent carbon layers apart resulting in expanded graphite.

Exemplary binders include a nonmetal, a metal, an alloy, or a combination comprising at least one of the foregoing. The nonmetal is selected from the group consisting of $SiO_2$, Si, B, $B_2O_3$, and a combination thereof. The metal can be aluminum, copper, titanium, nickel, tungsten, chromium, iron, manganese, zirconium, hafnium, vanadium, niobium, molybdenum, tin, bismuth, antimony, lead, cadmium, selenium, or a combination comprising at least one of the foregoing. The alloy includes aluminum alloys, copper alloys, titanium alloys, nickel alloys, tungsten alloys, chromium alloys, iron alloys, manganese alloys, zirconium alloys, hafnium alloys, vanadium alloys, niobium alloys, molybdenum alloys, tin alloys, bismuth alloys, antimony alloys, lead alloys, cadmium alloys, and selenium alloys. In an embodiment, the binder comprises copper, nickel, chromium, iron, titanium, an alloy of copper, an alloy of nickel, an alloy of chromium, an alloy of iron, an alloy of titanium, or a combination comprising at least one of the foregoing metal or metal alloy. Exemplary alloys include steel, nickel-chromium based alloys such as Inconel*, and nickel-copper based alloys such as Monel alloys. Nickel-chromium based alloys can contain about 40-75% of Ni, about 10-35% of Cr. The nickel-chromium based alloys can also contain about 1 to about 15% of iron. Small amounts of Mo, Nb, Co, Mn, Cu, Al, Ti, Si, C, S, P, B, or a combination comprising at least one of the foregoing can also be included in the nickel-chromium based alloys. Nickel-copper based alloys are primarily composed of nickel (up to about 67%) and copper. The nickel-copper based alloys can also contain small amounts of iron, manganese, carbon, and silicon. These materials can be in different shapes, such as particles, fibers, and wires. Combinations of the materials can be used.

The binder is micro- or nano-sized. In an embodiment, the binder has an average particle size of about 0.05 to about 10 microns, specifically, about 0.5 to about 5 microns, more specifically about 0.1 to about 3 microns. Without wishing to be bound by theory, it is believed that when the binder has a size within these ranges, it disperses uniformly among the expandable graphite particles.

The expandable graphite is present in an amount of about 20 wt. % to about 95 wt. %, about 20 wt. % to about 80 wt. %, or about 50 wt. % to about 80 wt. %, based on the total weight of the composition. The binder is present in an amount of 5 wt. % to 75 wt. % or 20 wt. % to 50 wt. %, based on the total weight of the composition. Advantageously, the binder melts or softens when exposed to microwave energy and binds expanded graphite together upon cooling to further improve the structural integrity of the resulting article. The binding mechanism includes mechanical interlocking, chemical bonding, or a combination thereof.

The composition can further comprise a filler such as carbon, carbon black, mica, clay, glass fiber, or ceramic materials. Exemplary carbon includes amorphous carbon, natural graphite, and carbon fiber. Exemplary ceramic materials include SiC, $Si_3N_4$, $SiO_2$, BN, and the like. These materials can be in different shapes, such as particles, fibers, and wires. Combinations of the materials can be used. The filler can be present in an amount of about 0.5 to about 10 wt. % or about 1 to about 8%, based on the total weight of the composition.

In addition to the expandable graphite containing composition, the device further comprises a fiber net. The fiber net constrains expandable graphite and prevents extrusion after setting up. The fiber net is flexible and can be formed by weaving or knitting materials that survive high pressure, high temperature, and sour environment. Exemplary fiber net materials include carbon fibers, metal wires, asbestos fibers, expandable graphite fibers. Metal wires include an iron-based wire, a stainless steel wire, a copper wire, a wire member made of a copper-nickel alloy, a copper-nickel-zinc alloy (nickel silver), brass, or beryllium copper. The mesh size of the fiber net is small enough to confine all the materials inside during service. In an embodiment, the net has a mesh size of 4 to 140, specifically 10 to 40. The fiber net can take the shape of a container, disposed exterior to and at least partially enclosing the expandable graphite containing composition.

The expandable graphite can be activated by application of microwave energy. Microwave energy has a wavelength of about 1 mm to about 1 meter. The expansion occurs rapidly. For example, exposing the expandable graphite to microwave energy within a few minutes, for example, about 3 to about 5 minutes can heat the intercallant past the boiling point and cause the graphite to expand to many times its original volume. One advantage of using microwave energy is that it can produce a high rate of heating. Once the microwave irradiation is generated, high temperatures can be reached within seconds and the expansion can start almost instantaneously. Microwave irradiation can be switched off once the graphite is expanded. In addition, microwave irradiation can focus on the graphite-containing composition only thus minimizing the risk of degradation of the tool due to the high temperatures generated by the microwave irradiation.

In an embodiment, the microwave energy is generated through a microwave source disposed in the vicinity of the expandable graphite composition. The microwave source can be operated to vary the level of microwave energy. Alternatively, the microwave energy is generated at another location and directed to the expandable graphite composition through a series of wave guides. For example, the microwave energy can be generated on the earth's surface and directed underground to the expandable graphite composition.

Figure 1B:
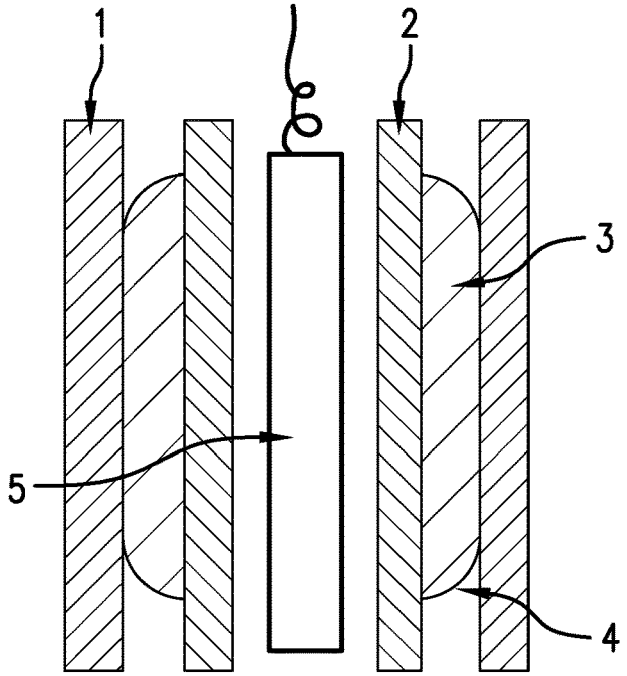
FIG. 1B shows a longitudinal cross-section of a casing, production tube, and downhole element where the downhole element forms a seal via microwave in-situ activation in an annulus of a wellbore between the casing and the production tube.

An exemplary method of deploying an apparatus in a wellbore is illustrated in FIGS. 1A and 1B. As shown in FIG. 1A, an expandable graphite containing composition 3 is seated against an outer diameter of a production tube 2. A fiber net 4 is superimposed on composition 3. A microwave generator 5 is positioned in the tubing near composition 3. The microwave generator 5 generates microwave energy directed to composition 3 causing the expandable graphite in composition 3 to expand thus filling the space between the outer diameter of the tube 2 and the casing 1.

Advantageously, the materials of the tube, particularly for the portion where expandable graphite containing composition is seated, are selected in such a way that they allow microwave to pass through without absorbing or reflecting any significant amount of microwave energy. In an embodiment, greater than about 70%, greater than about 80%, greater than about 90%, or greater than about 95% of the generated microwave energy reaches the expandable graphite containing composition. Such materials include high toughness ceramics such as alumina, zirconia, silicon carbide, silicon nitride, as well as composites based on these ceramic materials such as fiber enhanced ceramic composites.

In another embodiment, a method of deploying an apparatus comprises: positioning a device at a predetermined location; wherein the device comprises a composition that contains an expandable graphite, a binder, and an activation material comprising a thermite, a mixture of Al and Ni, or a combination comprising at least one of the foregoing, and wherein the composition has a first shape; and exposing the composition to a selected form of energy to cause the composition to attain a second shape different from the first shape. The method can further comprise isolating or completing a wellbore by deploying the apparatus in the wellbore.

Thermite and thermite-like compositions are usable as the activation material. Thermite compositions include, for example, a metal powder (a reducing agent) and a metal oxide (an oxidizing agent) that produces an exothermic oxidation-reduction reaction known as a thermite reaction. Choices for a reducing agent include aluminum, magnesium, calcium, titanium, zinc, silicon, boron, and combinations including at least one of the foregoing, for example, while choices for an oxidizing agent include boron oxide, silicon oxide, chromium oxide, manganese oxide, iron oxide, copper oxide, lead oxide and combinations including at least one of the foregoing, for example. Thermite-like compositions include a mixture of aluminum and nickel.

Use of thermite and thermite-like compositions is advantageous as the compositions are stable at wellbore temperatures but produce an extremely intense yet non-explosive exothermic reaction following activation. The activation can be achieved by exposing the graphite-containing composition including the activation material to a selected form of energy. The selected form of energy includes electric current; electromagnetic radiation, including infrared radiation, ultraviolet radiation, gamma ray radiation, and microwave radiation; or heat. The generated energy is absorbed by the expandable graphite and expands the device containing the expandable graphite. Meanwhile, the energy is localized therefore any potentially degradation to other parts of the apparatus is minimized.

Figure 2:
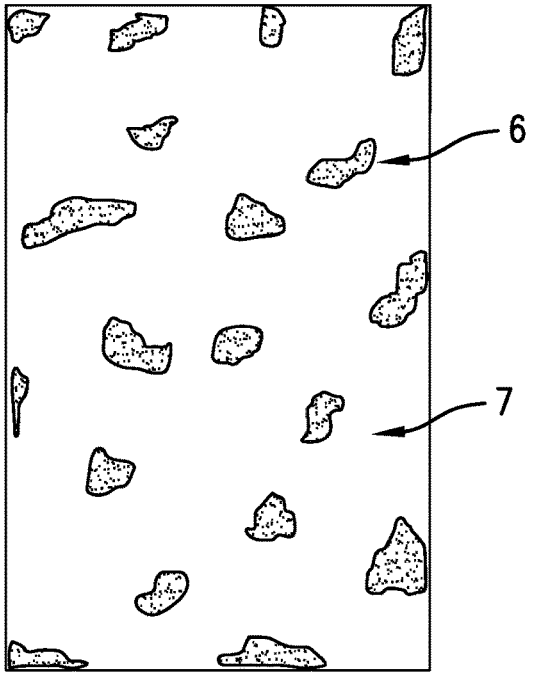
FIG. 2 is a schematic illustration of an exemplary embodiment of a composition comprising expandable graphite and an activation material.
Figure 3:
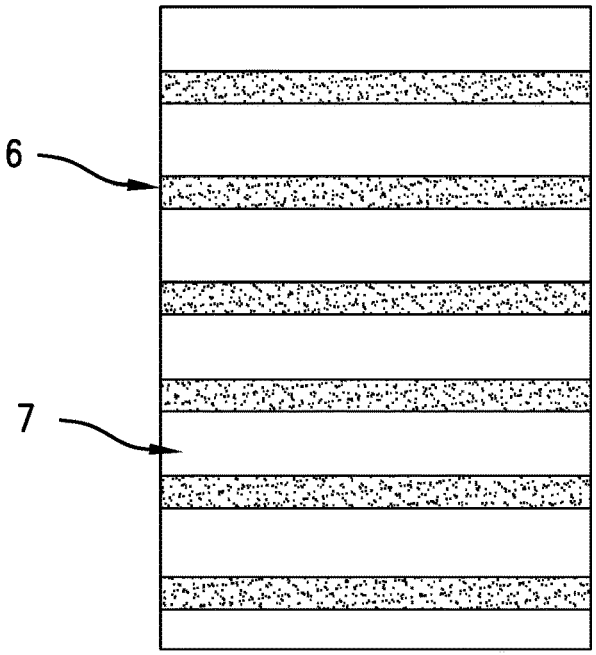
FIG. 3 is a schematic illustration of another exemplary embodiment of a composition comprising expandable graphite and an activation material.

The activation material can be powders, particles, pellets or the like dispersed in the expandable graphite matrix. Alternatively, the activation material is present in the form of foils which are dispersed in the expandable graphite. Exemplary embodiments of the composition are shown in FIGS. 2 and 3. As shown in these figures, activation material 6 can be evenly dispersed in the expandable graphite matrix 7.

The amount of the activation material is not particularly limited and is generally in an amount sufficient to generate enough energy to expand the expandable graphite when the activation material is exposed to the selected form of energy. In one embodiment, the activation material is present in an amount of about 0.5 wt. % to about 20 wt. % based on the total weight of the composition.

The composition can also include the binder and/or the filler described herein in the context of the compositions which can be activated by microwave energy.

The composition comprising expandable graphite can be used to make articles (devices or elements) for use in a variety of applications. As used herein, expandable graphite-containing compositions include both the compositions that can be activated by microwave energy and compositions that can be activated by a thermite or thermite-like activation material. In addition to the expandable graphite containing composition, the articles can further comprise a fiber net disposed exterior to and at least partially enclosing the composition as disclosed herein. An article using expandable graphite may be any device that is configured to expand to attain a shape different from its current shape. For example, the article can be of a type suited for filling an annulus within a borehole in a location surrounding one or more production tubulars. As used herein, the term "production tubulars" is defined to include, for example, any kind of tubular that is used in completing a well, such as, but not limited to, production tubing, production casing, intermediate casings, and devices through which hydrocarbons flow to the surface. Examples of such article include, in non-limiting embodiments, annular isolators used to block off non-targeted production or water zones, and the like.

Exemplary articles include seals, high pressure beaded frac screen plugs, screen basepipe plugs, coatings for balls and seats, gaskets, compression packing elements, expandable packing elements, O-rings, bonded seals, bullet seals, sub-surface safety valve seals, sub-surface safety valve flapper seal, dynamic seals, V-rings, back up rings, drill bit seals, liner port plugs, atmospheric discs, atmospheric chamber discs, debris barriers, drill in stim liner plugs, inflow control device plugs, flappers, seats, ball seats, direct connect disks, drill-in linear disks, gas lift valve plug, fluid loss control flappers, electric submersible pump seals, shear out plugs, flapper valves, gaslift valves, and sleeves. Specifically, the article is a seal, a packer, a fluid control device, a tubing having the composition disposed on a surface of the tubing. The shapes of the articles are not particularly limited. In an embodiment, the articles inhibit flow.

Various methods can be used to manufacture the device. In an embodiment, a method of forming a device comprises compounding expandable graphite; a binder; and optionally an activation material comprising a thermite, a mixture of Al and Ni, or a combination comprising at least one of the foregoing, to form a mixture; and compression molding the mixture at a temperature less than 100° F. The method further comprises disposing a fiber net on a surface of the product formed from compression molding. When the activation material is not included, the device can be activated by microwave energy. When the activation material is include, the device can be activated by exposing the activation material to a selected form of energy described herein.

The article that contains compositions that use expandable graphite, a binder, and an activation material may be placed at a predetermined suitable location and then activated or exposed to a suitable form of energy. In the instance where the article is disposed wellbore, the energy may be conveyed from a surface source into the wellbore or generated downhole. In one aspect, a radiation source may be conveyed with or after the placement of the device. The source may be activated once the device has been set. The activation material will absorb the radiation and heat, causing the expandable graphite to expand. The method includes methods for use as annular isolators, such as packer, and the like, as well as any uses in which space-filling following placement is desired.

All cited patents, patent applications, and other references are incorporated herein by reference in their entirety. However, if a term in the present application contradicts or conflicts with a term in the incorporated reference, the term from the present application takes precedence over the conflicting term from the incorporated reference.

All ranges disclosed herein are inclusive of the endpoints, and the endpoints are independently combinable with each other. The suffix "(s)" as used herein is intended to include both the singular and the plural of the term that it modifies, thereby including at least one of that term (e.g., the colorant (s) includes at least one colorants). "Or" means "and/or." "Optional" or "optionally" means that the subsequently described event or circumstance can or cannot occur, and that the description includes instances where the event occurs and instances where it does not. As used herein, "combination" is inclusive of blends, mixtures, alloys, reaction products, and the like. "A combination thereof" means "a combination comprising one or more of the listed items and optionally a like item not listed." All references are incorporated herein by reference.

The use of the terms "a" and "an" and "the" and similar referents in the context of describing the invention (especially in the context of the following claims) are to be construed to cover both the singular and the plural, unless otherwise indicated herein or clearly contradicted by context. Further, it should further be noted that the terms "first," "second," and the like herein do not denote any order, quantity, or importance, but rather are used to distinguish one element from another. The modifier "about" used in connection with a quantity is inclusive of the stated value and has the meaning dictated by the context (e.g., it includes the degree of error associated with measurement of the particular quantity).

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited.

What is claimed is:

1. A method of deploying an apparatus, the method comprising:

positioning a device at a predetermined location; wherein the device comprises a composition that contains an expandable graphite, a binder, and a fiber net disposed exterior to and at least partially enclosing the composition, the composition having a first shape; and exposing the composition to a microwave energy to cause the composition to attain a second shape different from the first shape.

2. The method of claim 1 further comprising disposing a microwave source in the vicinity of the device, wherein the microwave source is effective to generate a microwave energy to heat and expand the composition.

3. The method of claim 1, wherein the binder comprises a nonmetal, metal, an alloy of the metal, or a combination thereof;

wherein the nonmetal is selected from the group consisting of $SiO_2$, Si, B, $B_2O_3$, and a combination thereof; and the metal is selected from the group consisting of aluminum, copper, titanium, nickel, tungsten, chromium, iron, manganese, zirconium, hafnium, vanadium, niobium, molybdenum, tin, bismuth, antimony, lead, cadmium, selenium, and a combination thereof.

4. The method of claim 1, wherein the device is selected from the group consisting of seals, high pressure beaded frac screen plugs, screen basepipe plugs, coatings for balls and seats, gaskets, compression packing elements, expandable packing elements, 0-rings, bonded seals, bullet seals, sub-surface safety valve seals, sub-surface safety valve flapper seals, dynamic seals, V-rings, back up rings, drill bit seals, liner port plugs, atmospheric discs, atmospheric chamber discs, debris barriers, drill in stim liner plugs, inflow control device plugs, flappers, seats, ball seats, direct connect disks, drill-in linear disks, gas lift valve plug, fluid loss control flappers, electric submersible pump seals, shear out plugs, flapper valves, gaslift valves, and sleeves.

5. The method of claim 1, wherein the device is a seal, a packer, a fluid control device, a tubing having the composition disposed on a surface of the tubing.

6. The method of claim 1, wherein the method further comprises isolating or completing a wellbore by deploying the apparatus in the wellbore.

7. The method of claim 1, the method comprising:

positioning a tubing at a downhole location; wherein the tubing comprises a composition disposed on a surface of the tubing, the composition comprising an expandable graphite and a binder and having a first shape; and exposing the composition to a microwave energy to cause the composition to expand to isolate or complete the wellbore.

8. The method of claim 7, further comprises disposing a microwave source in the tubing.

9. A device comprising:

a composition that contains an expandable graphite and a binder; and a fiber net disposed exterior to and at least partially enclosing the composition;

wherein the binder comprises a nonmetal, metal, an alloy of the metal, or a combination thereof; wherein the nonmetal is selected from the group consisting of $SiO_2$, Si, B, $B_2O_3$, and a combination thereof; and the metal is selected from the group consisting of aluminum, copper, titanium, nickel, tungsten, chromium, iron, manganese, zirconium, hafnium, vanadium, niobium, molybdenum, tin, bismuth, antimony, lead, cadmium, selenium, and a combination thereof.

10. The device of claim 9 wherein the binder has a size of about 0.05 to about 10 microns.

11. A device comprising a composition containing:

an expandable graphite;

a binder; and an activation material comprising a thermite, a mixture of Al and Ni, or a combination comprising at least one of the foregoing, wherein the device further comprises a fiber net disposed exterior to and at least partially enclosing the composition.

12. The device of claim 11, wherein the thermite comprises a reducing agent comprising aluminum, magnesium, calcium, titanium, zinc, silicon, boron, and a combination comprising at least one of the foregoing reducing agent, and an oxidizing agent selected from boron oxide, silicon oxide, chromium oxide, manganese oxide, iron oxide, copper oxide, lead oxide, and a combination comprising at least one of the foregoing oxidizing agent.

13. The device of claim 11, wherein the binder comprises a nonmetal, metal, an alloy of the metal, or a combination thereof; and wherein the nonmetal is selected from the group consisting of $SiO_2$, Si, B, $B_2O_3$, and a combination thereof; and the metal is at least one of aluminum, copper, titanium, nickel, tungsten, chromium, iron, manganese, zirconium, hafnium, vanadium, niobium, molybdenum, tin, bismuth, antimony, lead, cadmium, and selenium.

14. The device of claim 11, wherein the device is selected from the group consisting of seals, high pressure beaded frac screen plugs, screen basepipe plugs, coatings for balls and seats, gaskets, compression packing elements, expandable packing elements, O-rings, bonded seals, bullet seals, sub-surface safety valve seals, sub-surface safety valve flapper seal, dynamic seals, V-rings, back up rings, drill bit seals, liner port plugs, atmospheric discs, atmospheric chamber discs, debris barriers, drill in stim liner plugs, inflow control device plugs, flappers, seats, ball seats, direct connect disks, drill-in linear disks, gas lift valve plug, fluid loss control flappers, electric submersible pump seals, shear out plugs, flapper valves, gaslift valves, and sleeves.

15. A method of preparing a device comprising:

compounding an expandable graphite; a binder; and an activation material comprising a thermite, a mixture of Al and Ni, or a combination comprising at least one of the foregoing, to form a mixture;

compression molding the mixture at a temperature less than 100° F. to form a compression molded product; and disposing a fiber net on a surface of the compression molded product.

16. A method of deploying an apparatus, the method comprising:

positioning a device at a predetermined location; wherein the device comprises a composition that contains an expandable graphite, a binder, and an activation material comprising a thermite, a mixture of Al and Ni, or a combination comprising at least one of the foregoing, and wherein the composition has a first shape; and exposing the composition to a selected form of energy to cause the composition to attain a second shape different from the first shape, wherein the device further comprises a fiber net disposed exterior to and at least partially enclosing the composition.

17. The method of claim 16, wherein the selected form of energy is at least one of electric current, an electromagnetic radiation, and heat.

18. The method of claim 16, wherein the method further comprises isolating or completing a wellbore by deploying the apparatus in the wellbore.

* * * * *